US008704807B2

(12) United States Patent
Chung et al.

(10) Patent No.: US 8,704,807 B2
(45) Date of Patent: Apr. 22, 2014

(54) SCAN DRIVER, METHOD OF DRIVING THE SCAN DRIVER, AND ORGANIC LIGHT-EMITTING DISPLAY INCLUDING THE SCAN DRIVER

(75) Inventors: Bo-Yong Chung, Yongin (KR); Dong-Hwi Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 463 days.

(21) Appl. No.: 12/986,013

(22) Filed: Jan. 6, 2011

(65) Prior Publication Data

US 2011/0273407 A1 Nov. 10, 2011

(30) Foreign Application Priority Data

May 7, 2010 (KR) ..... 10-2010-0043051

(51) Int. Cl.
*G09G 3/00* (2006.01)
*G09G 3/32* (2006.01)

(52) U.S. Cl.
CPC ..... *G09G 3/3266* (2013.01); *G09G 2310/0202* (2013.01); *G09G 2310/0286* (2013.01)
USPC ..... 345/204; 345/100; 345/214

(58) Field of Classification Search
CPC ..... G09G 3/3266
USPC ..... 345/214, 100; 257/359
See application file for complete search history.

(56) References Cited

U.S. PATENT DOCUMENTS

| | | | | |
|---|---|---|---|---|
| 2002/0190326 | A1* | 12/2002 | Nagao et al. | 257/359 |
| 2003/0231735 | A1 | 12/2003 | Moon et al. | |
| 2005/0156859 | A1* | 7/2005 | Jang et al. | 345/100 |
| 2007/0040771 | A1 | 2/2007 | Chung et al. | |
| 2010/0134476 | A1* | 6/2010 | Zebedee et al. | 345/214 |

FOREIGN PATENT DOCUMENTS

| | | | | |
|---|---|---|---|---|
| JP | 2009-063881 | | 3/2009 | |
| KR | 10-2004-0003287 | | 1/2004 | |
| KR | 10-2007-0022550 | | 2/2007 | |
| KR | 10-2007-0072011 | A | 7/2007 | |
| KR | 10-2007-0118386 | | 12/2007 | |
| KR | 10-2007-0121968 | A | 12/2007 | |
| KR | 10-2008-0000850 | A | 1/2008 | |
| KR | 1020100000568 | * | 1/2010 | G09G 5/00 |

OTHER PUBLICATIONS

KIPO Registration Determination Certificate dated Apr. 18, 2012 issued to priority KR Patent Application No. 10-2010-0043051 (5 pages).

* cited by examiner

*Primary Examiner* — Amare Mengistu
*Assistant Examiner* — Joseph G Rodriguez
(74) *Attorney, Agent, or Firm* — Christie, Parker & Hale, LLP

(57) ABSTRACT

A scan driver includes a plurality of stages and is capable of overlapped driving of scan signals output by each of the stages. A method of driving the scan driver, and an organic light emitting display device including the scan driver, is provided.

14 Claims, 10 Drawing Sheets

SCAN DRIVER, METHOD OF DRIVING THE SCAN DRIVER, AND ORGANIC LIGHT-EMITTING DISPLAY INCLUDING THE SCAN DRIVER

CROSS-REFERENCE TO RELATED APPLICATION

This application claims priority to and the benefit of Korean Patent Application No. 10-2010-0043051, filed on May 7, 2010, in the Korean Intellectual Property Office, the disclosure of which is incorporated herein in its entirety by reference.

BACKGROUND

1. Field

The present invention relates to a scan driver, a method of driving the scan driver, and an organic light-emitting display including the scan driver.

2. Description of the Related Art

Organic light-emitting displays are used as display devices for computers, mobile phones, personal digital assistants (PDAs), and other information devices. Compared to a cathode ray tube (CRT) device, an organic light-emitting display is relatively light and small and has excellent light emitting efficiency, brightness, viewing angle, and response speeds.

To drive a plurality of pixels, a scan driver included in an organic light-emitting display applies scan signals to scan lines, so that desired data is applied to pixels by a data driver.

SUMMARY

Embodiments according to the present invention provide a scan driver, which includes a plurality of stages, and is capable of overlapped driving of scan signals output by each of the stages, a method of driving the scan driver, and an organic light emitting display device including the scan driver.

In one embodiment according to the present invention, a scan driver includes: a first stage having a clock terminal electrically coupled to a first clock line and a control terminal electrically coupled to a first control line; and a second stage having a clock terminal electrically coupled to a second clock line and a control terminal electrically coupled to a second control line.

The first stage may include an input terminal electrically coupled to an initial input line, a next stage start terminal electrically coupled to an input terminal of the second stage, and an output terminal electrically coupled to a first scan line.

The second stage may include an input terminal electrically coupled to a next stage start terminal of the first stage, a next stage start terminal electrically coupled to an input terminal of a next stage, and an output terminal electrically coupled to a second scan line.

Each of the first stage and the second stage may include: a first switching device having a control electrode electrically coupled to an input terminal, the first switching device being coupled between a first power voltage line and a first node; a second switching device having a control electrode electrically coupled to the input terminal, the second switching device being coupled between a second power voltage line and a second node; a third switching device having a control electrode electrically coupled to the first switching device; a fourth switching device having a control electrode electrically coupled to the first switching device, the fourth switching device being coupled between the third switching device and the second node, wherein the third switching device is coupled between the first power voltage line and the fourth switching device; a fifth switching device having a control electrode electrically coupled to the first control line, the fifth switching device being coupled between the second power voltage line and the first node; a sixth switching device having a control electrode electrically coupled to the first node, the sixth switching device being coupled between the first power voltage line and a third node; a seventh switching device having a control electrode electrically coupled to the second node, the seventh switching device being coupled between the third node and the clock terminal; an eighth switching device having a control electrode electrically coupled to the first node, the eighth switching device being coupled between the first power voltage line and an output terminal; a ninth switching device having a control electrode electrically coupled to the second node, the ninth switching device being coupled between the output terminal and the second power voltage line; a first capacitor coupled between the first power voltage line and the control electrode of the sixth switching device; a second capacitor coupled between the control electrode of the seventh switching device and the third node; and a third capacitor coupled between the control electrode of the ninth switching device and the output terminal.

The input terminal of the first stage may be electrically coupled to an initial input line, the output terminal of the first stage may be electrically coupled to a first scan line, and a next stage start terminal of the first stage may be electrically coupled to the input terminal of the second stage.

The input terminal of the second stage may be electrically coupled to a next stage start terminal of the first stage, the output terminal of the second stage may be electrically coupled to a second scan line, and a next stage start terminal of the second stage may be electrically coupled to the input terminal of a next stage.

The switching devices may include PMOS transistors.

The scan driver may further include a tenth switching device having a control electrode electrically coupled to a reset terminal, the tenth switching device being coupled between the first node and the second power voltage line.

The scan driver may further include a third stage, wherein a clock terminal of the third stage is electrically coupled to the first clock line, and a control terminal of the third stage is electrically coupled to a third control line.

The scan driver may further include a third stage, wherein a clock terminal of the third stage is electrically coupled to a third clock line, and a control terminal of the third stage is electrically coupled to a third control line.

In another embodiment according to the present invention, a method of driving a scan driver including a plurality of stages sequentially outputting output signals, is provided. The method includes: outputting a first output signal to a first scan line in response to an initial input signal and outputting a first next stage start signal to a next stage in response to a first clock signal; outputting a second output signal to a second scan line in response to the first next stage start signal; stopping the outputting of the first output signal in response to a first control signal while the second output signal is being output; and stopping the outputting of the second output signal in response to a second control signal, wherein the first output signal and the second output signal partially overlap each other.

The outputting the second output signal to the second scan line in response to the first next stage start signal may include outputting the second output signal to the second scan line in response to the first next stage start signal and outputting a second next stage start signal to a next stage in response to a second clock signal, wherein the method may further include outputting a third output signal to a third scan line in response to the second next stage start signal, wherein the stopping the outputting of the second output signal in response to the second control signal may include stopping the outputting of the second output signal in response to the second control signal while the third output signal is being output, wherein the method may further include stopping the outputting of the third output signal in response to a third control signal, and wherein the second output signal and the third output signal may partially overlap each other.

In another exemplary embodiment according to the present invention, an organic light emitting display device includes: an organic light emitting display panel; a scan driver configured to sequentially provide scan signals to the organic light emitting display panel via a plurality of scan lines; and a data driver configured to provide data signals to the organic light emitting display panel via a plurality of data lines, wherein the scan driver includes: a first stage having a clock terminal electrically coupled to a first clock line and a control terminal electrically coupled to a first control line; and a second stage having a clock terminal electrically coupled to a second clock line and a control terminal electrically coupled to a second control line.

The first stage may include an input terminal electrically coupled to an initial input line, a next stage start terminal electrically coupled to an input terminal of the second stage, and an output terminal electrically coupled to a first scan line of the plurality of scan lines.

The second stage may include an input terminal electrically coupled to a next stage start terminal of the first stage, a next stage start terminal electrically coupled to an input terminal of a next stage, and an output terminal electrically coupled to a second scan line of the plurality of scan lines.

Each of the first stage and the second stage may include: a first switching device having a control electrode electrically coupled to an input terminal, the first switching device being coupled between a first power voltage line and a first node; a second switching device having a control electrode electrically coupled to the input terminal, the second switching device being coupled between a second power voltage line and a second node; a third switching device having a control electrode electrically coupled to the first switching device; a fourth switching device having a control electrode electrically coupled to the first switching device, the fourth switching device being coupled between the third switching device and the second node, wherein the third switching device is coupled between the first power voltage line and the fourth switching device; a fifth switching device having a control electrode electrically coupled to the first control line, the fifth switching device being coupled between the second power voltage line and the first node; a sixth switching device having a control electrode electrically coupled to the first node, the sixth switching device being coupled between the first power voltage line and a third node; a seventh switching device having a control electrode electrically coupled to the second node, the seventh switching device being coupled between the third node and the clock terminal; an eighth switching device having a control electrode electrically coupled to the first node, the eighth switching device being coupled between the first power voltage line and an output terminal; a ninth switching device having a control electrode electrically coupled to the second node, the ninth switching device being coupled between the output terminal and the second power voltage line; a first capacitor coupled between the first power voltage line and the control electrode of the sixth switching device; a second capacitor coupled between the control electrode of the seventh switching device and the third node; and a third capacitor coupled between the control electrode of the ninth switching device and the output terminal.

The input terminal of the first stage may be electrically coupled to an initial input line, the output terminal of the first stage may be electrically coupled to a first scan line of the plurality of scan lines, and a next stage start terminal of the first stage may be electrically coupled to the input terminal of the second stage.

input terminal of the second stage may be electrically coupled to a next stage start terminal of the first stage, the output terminal of the second stage may be electrically coupled to a second scan line of the plurality of scan lines, and a next stage start terminal of the second stage may be electrically coupled to an input terminal of a next stage.

The switching devices may include PMOS transistors.

Each of the first stage and the second stage may further include a tenth switching device having a control electrode electrically coupled to a reset terminal, the tenth switching device being coupled between the first node and the second power voltage line.

The organic light emitting display device may further include a third stage, wherein a clock terminal of the third stage is electrically coupled to the first clock line, and a control terminal of the third stage is electrically coupled to a third control line.

The organic light emitting display device may further include a third stage, wherein a clock terminal of the third stage is electrically coupled to a third clock line, and a control terminal of the third stage is electrically coupled to the third control line.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Figure 1:
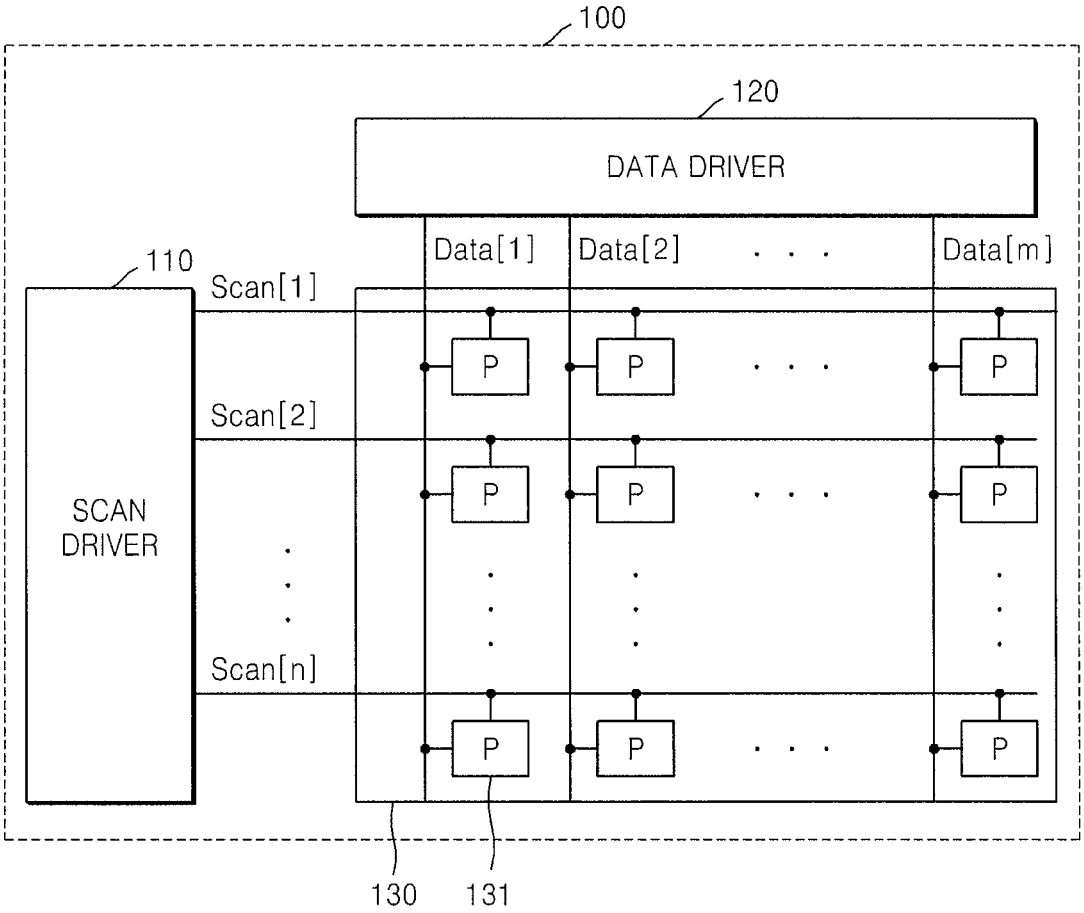
FIG. 1 is a block diagram showing a configuration of an organic light-emitting display according to an embodiment of the present invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In the description of the present invention, certain detailed explanations of related art are omitted when it is deemed that they may unnecessarily obscure the essence of the invention.

While such terms as "first," "second," etc., may be used to describe various components, such components are not limited to the above terms. The above terms are used only to distinguish one component from another.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Embodiments of the invention will be described below in more detail with reference to the accompanying drawings. Those components that are the same or are in correspondence are rendered the same reference numeral regardless of the figure number, and redundant explanations are generally omitted.

FIG. 1 is a block diagram showing a configuration of an organic light emitting display (e.g., an organic light emitting display device) 100 according to an embodiment of the present invention.

Referring to FIG. 1, the organic light emitting display 100 includes a scan driver 110, a data driver 120, and an organic light emitting display panel (referred to hereinafter as a panel 130).

The scan driver 110 may sequentially provide scan signals to the panel 130 via scan lines Scan[1], Scan[2], . . . , Scan [n].

The data driver 120 may sequentially provide data signals to the panel 130 via data lines Data[1], Data[2], . . . , Data[m].

Furthermore, the panel 130 may include a plurality of scan lines Scan[1], Scan[2], . . . , Scan[3*n*], which are arranged in (e.g., extend in) a row direction, a plurality of data lines Data[1], Data[2], . . . , Data[m], which are arranged in (e.g., extend in) a column direction, and pixels 131, which are located at crossing regions of the plurality of scan lines Scan [1], Scan[2], . . . , Scan[3*n*] and the plurality of data lines Data[1], Data[2], . . . , Data[m].

Here, the pixel 131 may be formed in a pixel region defined by two adjacent scan lines and two adjacent data lines. As described above, scan signals may be provided to the scan lines Scan[1], Scan[2], . . . , Scan[3*n*] by the scan driver 110, whereas data signals may be provided to the data lines Data [1], Data[2], . . . , Data[m] by the data driver 120.

The panel 130 receives a first power voltage (not shown) and a second power voltage (not shown) from outside and provides the first power voltage and the second power voltage to each of the pixels 131. Each of the pixels 131 receiving the first power voltage and the second power voltage emits light from a light emitting device (e.g., organic light emitting diode (OLED)) included therein in accordance with data signals by controlling a current from the second power voltage to the first power voltage. For example, the second power voltage may be at a higher potential than the first power voltage.

Figure 2:
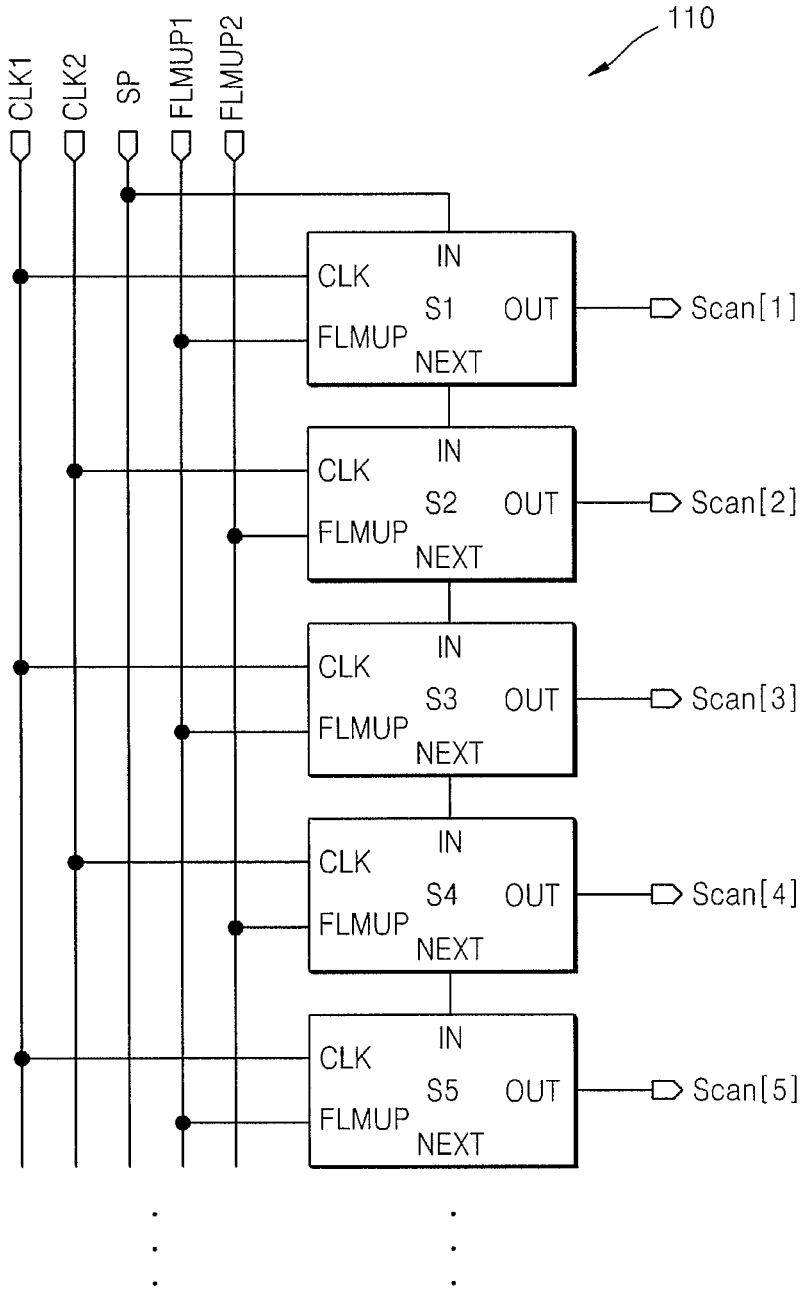
FIG. 2 is a diagram of a scan driver shown in FIG. 1, according to an embodiment of the present invention.

FIG. 2 is a diagram of the scan driver 110 shown in FIG. 1, according to an embodiment of the present invention.

Referring to FIG. 2, the scan driver 110 includes a plurality of stages, including a first stage S1, a second stage S2, a third stage S3, a fourth stage S4, a fifth stage S5, and so on.

A clock terminal CLK of the first stage S1 is electrically coupled to a first clock line CLK1, and a flmup terminal FLMUP (e.g., a control terminal) of the first stage S1 is electrically coupled to a first FLMUP line FLMUP1 (e.g., a first control line). Furthermore, an input terminal IN of the first stage S1 is electrically coupled to an initial input line SP. The first stage S1 receives an initial input signal from the initial input line SP through the input terminal IN, and outputs a first scan signal to a first scan line Scan[1] via an output terminal OUT. Furthermore, a next terminal NEXT (e.g., a next stage start terminal) of the first stage S1 is electrically coupled to an input terminal IN of the second stage S2. The first stage S1 provides a first next signal (e.g., a first next stage start signal) through the next terminal NEXT to the input terminal IN of the second stage S2.

A clock terminal CLK of the second stage S2 is electrically coupled to a second clock line CLK2, and the flmup terminal FLMUP (e.g., the control terminal) of the second stage S2 is electrically coupled to a second FLMUP line FLMUP2 (e.g., a second control line). Furthermore, the input terminal IN of the second stage S2 is electrically coupled to the next terminal NEXT of the first stage S1. The second stage S2 receives the first next signal from the first stage S1 through the input terminal IN, and outputs a second scan signal to a second scan line Scan[2] via an output terminal OUT. Furthermore, a next terminal NEXT (e.g., a next stage start terminal) of the second stage S2 is electrically coupled to an input terminal IN of the third stage S3. The second stage S2 outputs a second next signal (e.g., a second next stage start signal) to the input terminal IN of the third stage S3 through the next terminal NEXT. In other words, a next terminal of a previous stage is electrically coupled to an input terminal of a current stage, so that the current stages receive a next signal from the previous stage and outputs a scan signal. According to embodiments of the present invention, a next signal is not affected (or substantially not affected) by the load of an output terminal, and thus a next signal from the current stage is provided to (or used by) the next stage without a delay (e.g., RC delay) or with a reduced delay (e.g., as compared to when the output signal is provided to the next stage).

The third through fifth stages S3 through S5 are electrically coupled and are driven in substantially the same manner as the first and second stages S1 and S2 described above, and thus detailed descriptions thereof will be omitted.

Figure 3:
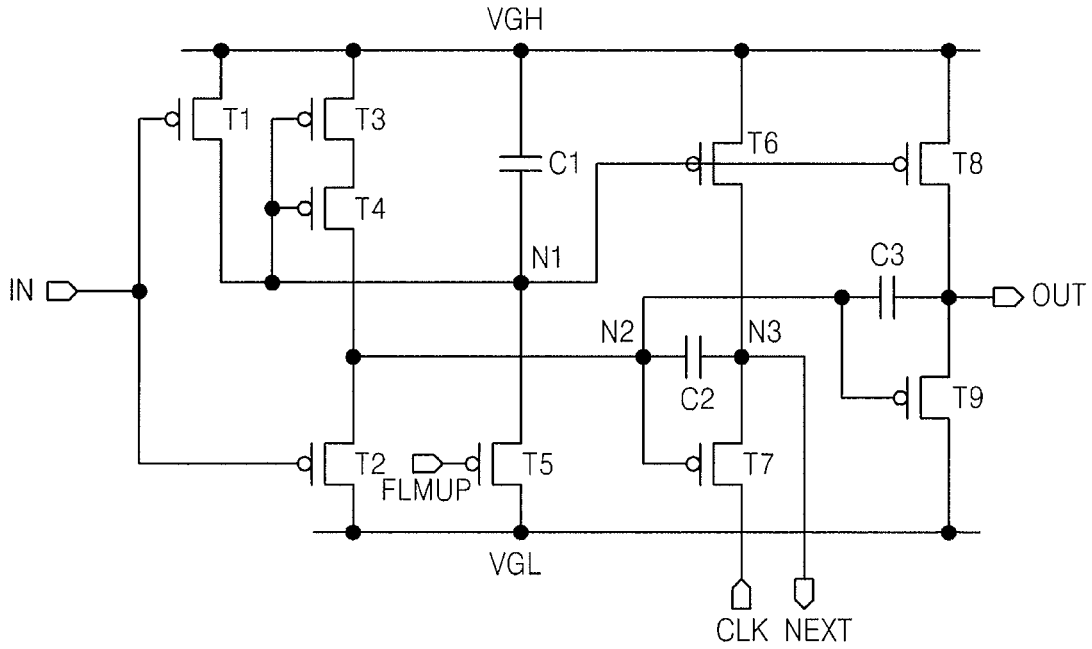
FIG. 3 is a circuit diagram of the scan driver shown in FIG. 2, according to an embodiment of the present invention.

FIG. 3 is a circuit diagram of the scan driver 110 shown in FIG. 2, according to an embodiment of the present invention. Each scan driver circuit described below refers to a scan driver circuit of each of the stages shown in FIG. 2. In other words, scan driver circuits included in the first through fifth stages S1 through S5 according to one embodiment are each substantially equivalent to the scan driver circuit shown in FIG. 3. Here, descriptions will be given with respect to the first stage S1.

Referring to FIG. 3, the first stage S1 includes first through ninth switching devices T1 through T9 and first through third capacitors C1 through C3. In one embodiment, the first through ninth switching devices T1 through T9 may be p-type metal-oxide-semiconductor (PMOS) field effect transistors.

A control electrode (e.g., a gate electrode) of the first switching device T1 is electrically coupled to the input terminal IN of the first stage S1, a first electrode corresponding to a drain electrode or a source electrode of the first switching device T1 is electrically coupled to a first power voltage line VGH, and a second electrode (e.g., a source electrode or a drain electrode) of the first switching device T1 is electrically coupled to a first node N1, which is electrically coupled to a control electrode of the third switching device T3, a control electrode of the fourth switching device T4, a control electrode of the sixth switching device T6, and a control electrode of the eighth switching device T8.

When a low-level input signal is applied to the control electrode of the first switching device T1, the first switching device T1 is turned on and applies a first power voltage VGH to the control electrode of the third switching device T3, the control electrode of the fourth switching device T4, the control electrode of the sixth switching device T6, and the control electrode of the eighth switching device T8.

A control electrode of the second switching device T2 is electrically coupled to the input terminal IN of the first stage S1, a first electrode of the second switching device T2 is electrically coupled to a second node N2, which is electrically coupled to a control electrode of the seventh switching device T7, and a second electrode of the second switching device T2 is electrically coupled to a second power voltage line VGL. When a low-level input signal is applied to the control electrode of the second switching device T2, the second switching device T2 is turned on and applies a second power voltage VGL to the control electrode of the seventh switching device T7.

The control electrode of the third switching device T3 is electrically coupled to the first node N1, which is electrically coupled to the second electrode of the first switching device T1. A first electrode of the third switching device T3 is electrically coupled to the first power voltage line VGH, and a second electrode of the third switching device T3 is electrically coupled to a first electrode of the fourth switching device T4.

A control electrode of the fourth switching device T4 is electrically coupled to the first node N1, which is electrically coupled to the second electrode of the first switching device T1. The first electrode of the fourth switching device T4 is electrically coupled to the second electrode of the third switching device T3, and a second electrode of the fourth switching device T4 is electrically coupled to the second node N2. The second node N2 is electrically coupled to the first electrode of the second switching device T2, the control electrode of the seventh switching device T7, and a control electrode of the ninth switching device T9. The third switching device T3 and the fourth switching device T4 may be formed as a single switching device in another embodiment.

A control electrode of the fifth switching device T5 is electrically coupled to the flmup terminal FLMUP of the first stage S1, a first electrode of the fifth switching device T5 is electrically coupled to the first node N1, and a second electrode of the fifth switching device T5 is electrically coupled to the second power voltage line VGL. The first node N1 is electrically coupled to the control electrode of the third switching device T3, the control electrode of the fourth switching device T4, the control electrode of the sixth switching device T6, and the control electrode of the eighth switching device T8.

When a low-level signal is applied to the flmup terminal FLMUP of the first stage S1, which is electrically coupled to the control electrode of the fifth switching device T5, the fifth switching device T5 is turned on and applies a second power voltage VGL to the first node N1. When the second power voltage VGL is applied to the control electrode of the third switching device T3 and the control electrode of the fourth switching device T4, the third switching device T3 and the fourth switching device T4 are turned on and apply a first power voltage VGH to the second node N2.

The control electrode of the sixth switching device T6 is electrically coupled to the first node N1, a first electrode of the sixth switching device T6 is electrically coupled to the first power voltage line VGH, and a second electrode of the sixth switching device T6 is electrically coupled to a third node N3, which is electrically coupled to a first electrode of the seventh switching device 17. When a low-level signal is applied to the first node N1, the sixth switching device T6 is turned on and applies a first power voltage VGH to the third node N3.

The control electrode of the seventh switching device T7 is electrically coupled to the second node N2, the first electrode of the seventh switching device 17 is electrically coupled to the third node N3, which is electrically coupled to the next terminal NEXT of the first stage S1, and a second electrode of the seventh switching device T7 is electrically coupled to the clock terminal CLK of the first stage S1. When a low-level signal is applied to the second node N2, the seventh switching device 17 is turned on.

The control electrode of the eighth switching device T8 is electrically coupled to the first node N1, a first electrode of the eighth switching device T8 is electrically coupled to the first power voltage line VGH, and a second electrode of the eighth switching device T8 is electrically coupled to the output terminal OUT of the first stage S1. When a low-level signal is applied to the first node N1, the eighth switching device T8 is turned on and outputs a first power voltage VGH to the output terminal OUT of the first stage S1.

The control electrode of the ninth switching device T9 is electrically coupled to the second node N2, a first electrode of the ninth switching device T9 is electrically coupled to the output terminal OUT of the first stage S1, and a second electrode of the ninth switching device T9 is electrically coupled to the second power voltage line VGL. When a low-level signal is applied to the second node N2, the ninth switching device T9 is turned on and outputs a second power voltage VGL to the output terminal OUT of the first stage S1.

The first capacitor C1 is coupled between the first power voltage line VGH and the first node N1. The first capacitor C1 stores a voltage difference between the control electrode of the sixth switching device T6 and the first electrode of the sixth switching device T6.

The second capacitor C2 is coupled between the control electrode of the seventh switching device T7 and the first electrode of the seventh switching device T7. The second capacitor C2 stores a voltage difference between the control electrode of the seventh switching device T7 and the first electrode of the seventh switching device T7.

The third capacitor C3 is coupled between the control electrode of the ninth switching device T9 and the output terminal OUT of the first stage S1. The third capacitor C3 stores a voltage difference between the control electrode of the ninth switching device T9 and the first electrode of the ninth switching device T9.

Figure 4:
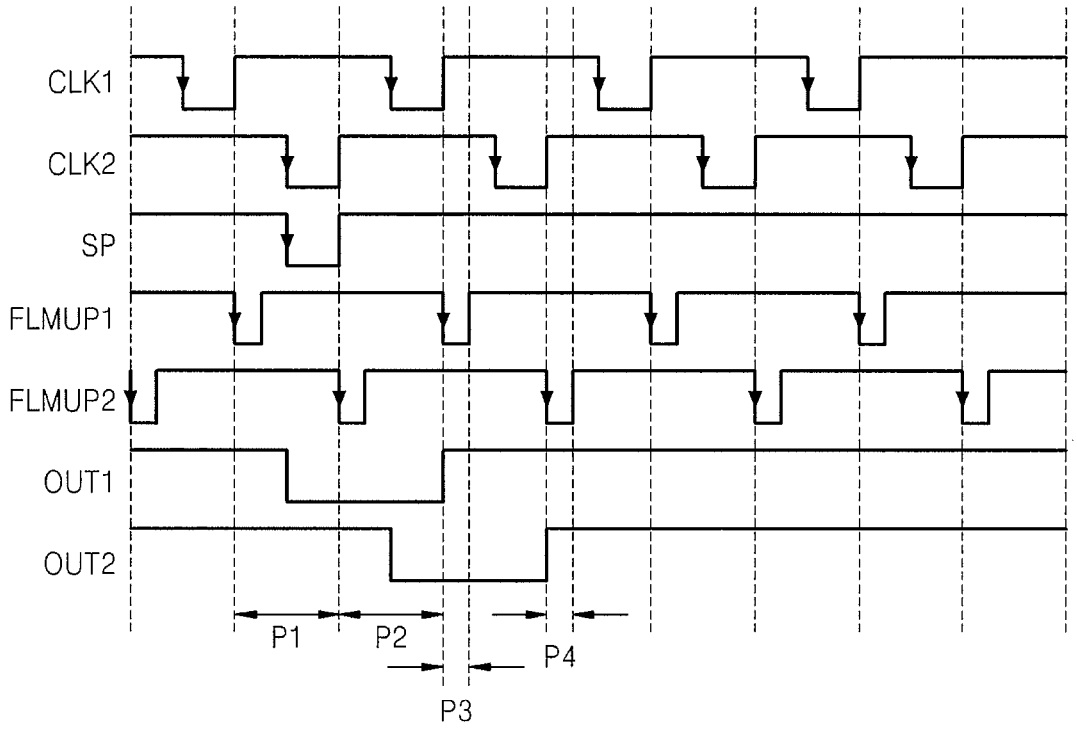
FIG. 4 is a timing diagram illustrating an example of an operation of the scan driver circuit shown in FIG. 3.

FIG. 4 is a timing diagram illustrating an example of an operation of the scan driver circuit shown in FIG. 3.

Figure 5:
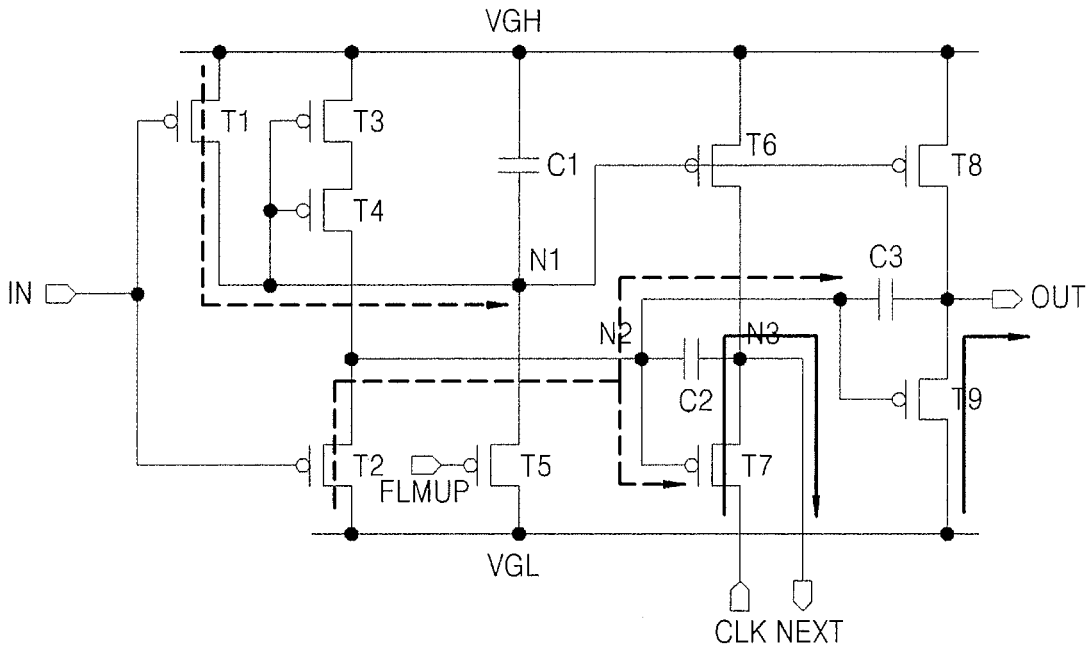
FIGS. 5 and 6 are circuit diagrams illustrating an example of an operation of the scan driver circuit shown in FIG. 3.
Figure 6:
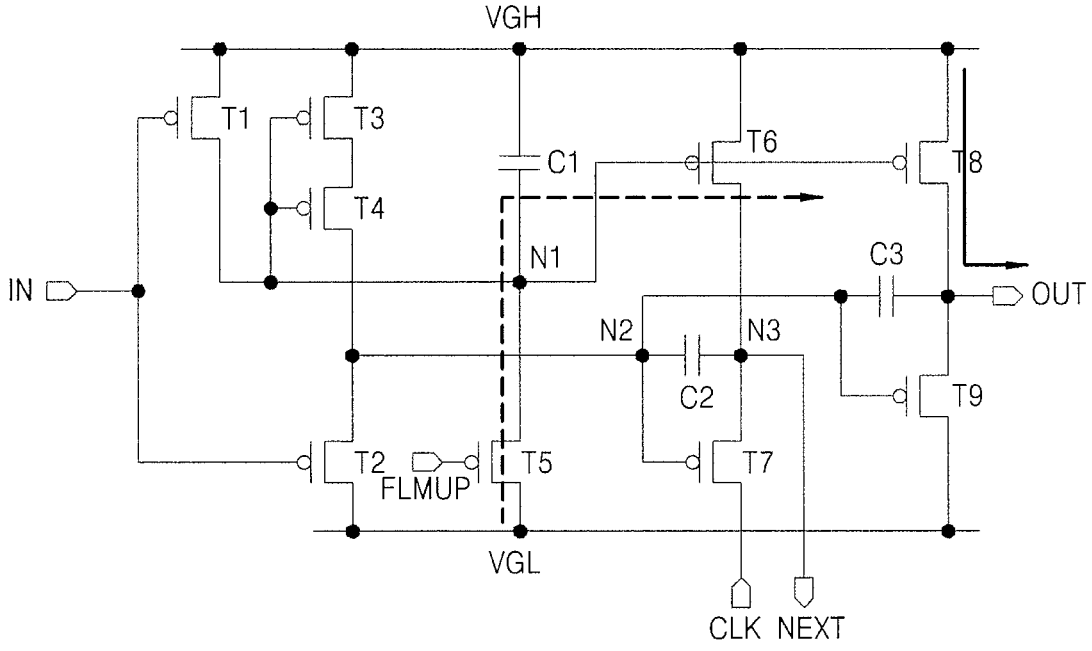

FIGS. 5 and 6 are circuit diagrams illustrating an example of an operation of the scan driver circuit shown in FIG. 3.

Referring to FIG. 4, the timing diagram of the scan driver circuit includes a first operation period P1, a second operation period P2, a third operation period P3, and a fourth operation period P4.

The first operation period P1 is related to the first stage S1. During the first operation period P1, a low-level initial input signal is applied to the input terminal IN of the first stage S1 via the initial input line SP, and a high-level first FLMUP signal (e.g., a high-level first control signal) is applied to the flmup terminal FLMUP of the first stage S1 via the first FLMUP line FLMUP1. Referring to FIG. 5, a low-level initial input signal is applied to the input terminal IN of the first stage S1, and thus the first switching device T1 and the second switching device T2 are turned on. As the first switching device T1 is turned on, a first power voltage VGH is applied to the first node N1. Furthermore, as the second switching device T2 is turned on, a second power voltage VGL is applied to the second node N2. When the second power voltage VGL is applied to the second node N2, the ninth switching device T9 is turned on and outputs a second power voltage VGL to the output terminal OUT of the first stage S1. Furthermore, when a second power voltage VGL is applied to the second node N2, the seventh switching device T7 is turned on. In detail, the second node N2 is pre-charged as much as the second power voltage VGL and the threshold voltage Vth of the seventh switching device T7 by the third capacitor C3, and thus the seventh switching device T7 is turned on. Furthermore, since a high-level first FLMUP signal is applied to the control electrode of the fifth switching device T5 via the first FLMUP line FLMUP1, the fifth switching device T5 stays turned off.

The second operation period P2 is related to the first stage S1 and the second stage S2. First, the operation of the first stage S1 will be described. Referring to FIG. 5, during the second first operation period P2, a first clock signal is applied to the clock terminal CLK of the first stage S1 via the first clock line CLK1. At this point, if a low-level first clock signal is applied to the second electrode of the seventh switching device T7 of the first'stage S1, the voltage level of the third node N3 begins to drop to the voltage level of a second power voltage VGL via the seventh switching device T7. At this point, a bootstrap occurs via the third capacitor C3, and thus the voltage level of the second node N2 drops to a point significantly lower than the voltage level of the second power voltage VGL. As a result, the seventh switching device T7 is completely turned on. Therefore, the voltage level of the third node N3 completely drops to the voltage level of the second power voltage VGL according to the low-level first clock signal. Here, for example in one embodiment, the low-level first clock signal has a voltage that is substantially the same as the voltage of the second power voltage VGL. At this point, the second power voltage VGL of the third node N3 is output to the next terminal NEXT of the first stage S1 as a first next signal and is applied to the input terminal IN of the second stage S2. As described above, a successive shift registering is performed between stages adjacent to each other.

The operation of the second stage S2 during the second operation period P2 will be described below. A low-level first next signal is applied to the input terminal IN of the second stage S2, and thus the first switching device T1 and the second switching device T2 of the second stage S2 are turned on. As the first switching device T1 is turned on, a first power voltage VGH is applied to the first node N1. Furthermore, as the second switching device T2 is turned on, a second power voltage VGL is applied to the second node N2. When the second power voltage VGL is applied to the second node N2, the ninth switching device T9 is turned on and outputs a second power voltage VGL to the output terminal OUT of the second stage S2. Furthermore, when a second power voltage VGL is applied to the second node N2, the seventh switching device T7 is turned on.

During the second operation period P2, since a high-level first FLMUP signal is applied to the flmup terminal FLMUP of the first stage S1, the fifth switching device T5 of the first stage S1 stays turned off. Furthermore, since a high-level second FLMUP signal (e.g., a high-level second control signal) is applied to the flmup terminal FLMUP of the second stage S2, the fifth switching device T5 of the second stage S2 stays turned off.

The third operation period P3 is related to the first stage S1. During the third operation period P3, a high-level initial input signal is applied to the input terminal IN of the first stage S1 via the initial input line SP, and a high-level first clock signal is applied to the clock terminal CLK of the first stage S1 via the first clock line CLK1. Furthermore, a low-level first FLMUP signal (e.g., a low-level first control signal) is applied to the flmup terminal FLMUP of the first stage S1 via the first FLMUP line FLMUP1. Referring to FIG. 6, a high-level initial input signal is applied to the input terminal IN of the first stage S1, and thus the first switching device T1 and the second switching device T2 are turned off. However, since the low-level first FLMUP signal is applied to the control electrode of the fifth switching device T5, the fifth switching device T5 is turned on. When the fifth switching device T5 is turned on, a second power voltage VGL is applied to the first node N1, and thus the eighth switching device T8 is turned on and outputs a first power voltage VGH to the output terminal OUT of the first stage S1.

The fourth operation period P4 is related to the second stage S2. During the fourth operation period P4, a high-level first next signal is applied to the input terminal IN of the second stage S2, and a high-level second clock signal is applied to the clock terminal CLK of the second stage S2 via the second clock line CLK2. Furthermore, a low-level second FLMUP signal (e.g., a low-level second control signal) is applied to the flmup terminal FLMUP of the second stage S2 via the second FLMUP line FLMUP2. As the high-level first next signal is applied to the input terminal IN of the second stage S2, the first switching device T1 and the second switching device T2 are turned off. However, since the low-level second FLMUP signal is applied to the control electrode of the fifth switching device T5, the fifth switching device T5 is turned on. When the fifth switching device T5 is turned on, a second power voltage VGL is applied to the first node N1, and thus the eighth switching device T8 is turned on and outputs a first power voltage VGH to the output terminal OUT of the second stage S2.

Referring to FIG. 4, the first power voltage VGH output by an output terminal OUT is a high-level voltage, whereas the second power voltage VGL output by an output terminal OUT is a low-level voltage.

Figure 7:
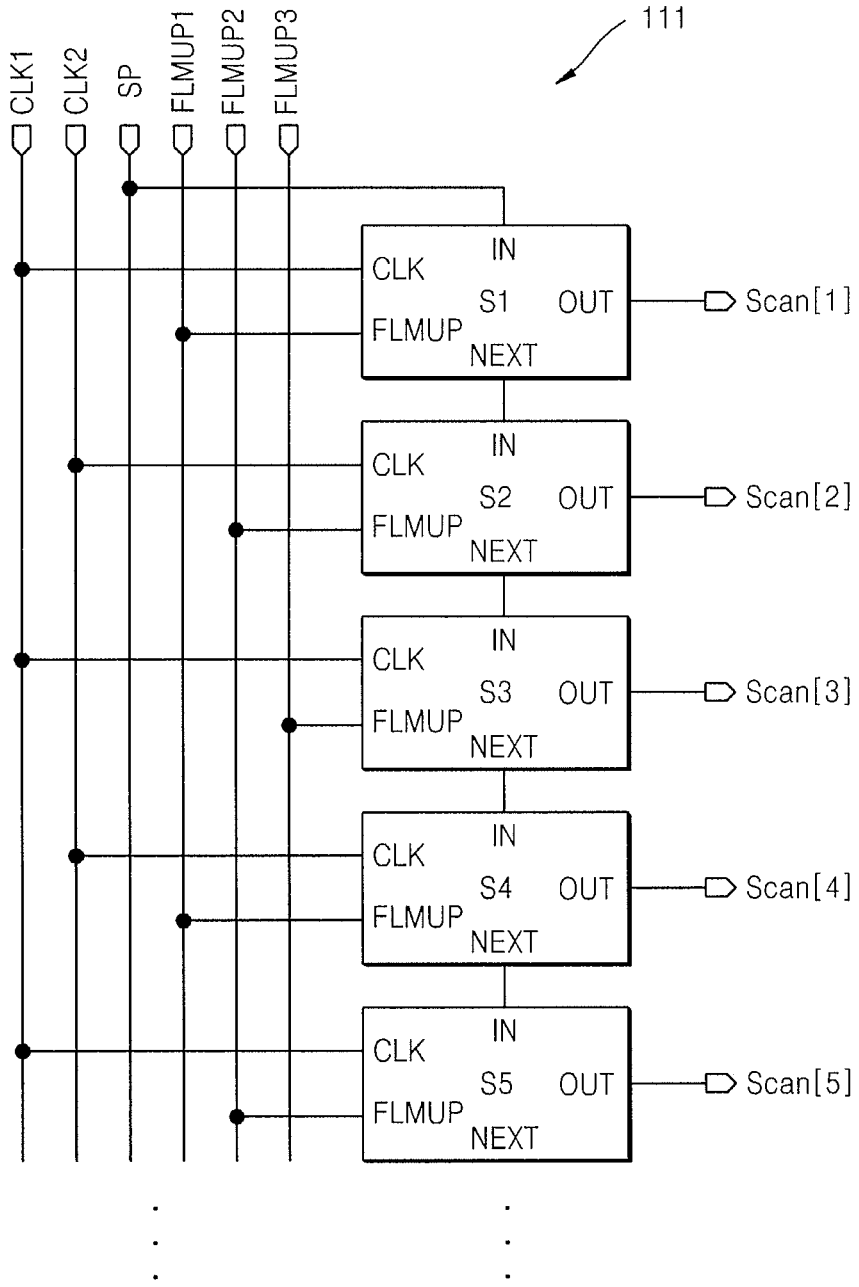
FIG. 7 is a diagram of a scan driver according to another embodiment of the present invention.

FIG. 7 is a diagram of a scan driver 111 according to another embodiment of the present invention. The scan driver 111, for example, may replace the scan driver 110 of FIG. 1 in some embodiments. Each of stages shown in FIG. 7 contains the circuit configuration shown in FIG. 3.

According to the embodiment illustrated in FIG. 7, the scan driver 111 may further include a third FLMUP line FLMUP3 (e.g., a third control line), compared to the scan driver 111 of FIG. 2. Referring to FIG. 7, the clock terminal CLK of the third stage S3 is electrically coupled to the first clock line CLK1, and the flmup terminal FLMUP of the third stage S3 is electrically coupled to the third FLMUP line FLMUP3. The clock terminal CLK of the fourth stage S4 is electrically coupled to the second clock line CLK2, and the flmup terminal FLMUP of the fourth stage S4 is electrically coupled to the first FLMUP line FLMUP1. The clock terminal CLK of the fifth stage S5 is electrically coupled to the first clock line CLK1, and the flmup terminal FLMUP of the fifth stage S5 is electrically coupled to the second FLMUP line FLMUP2.

Figure 8:
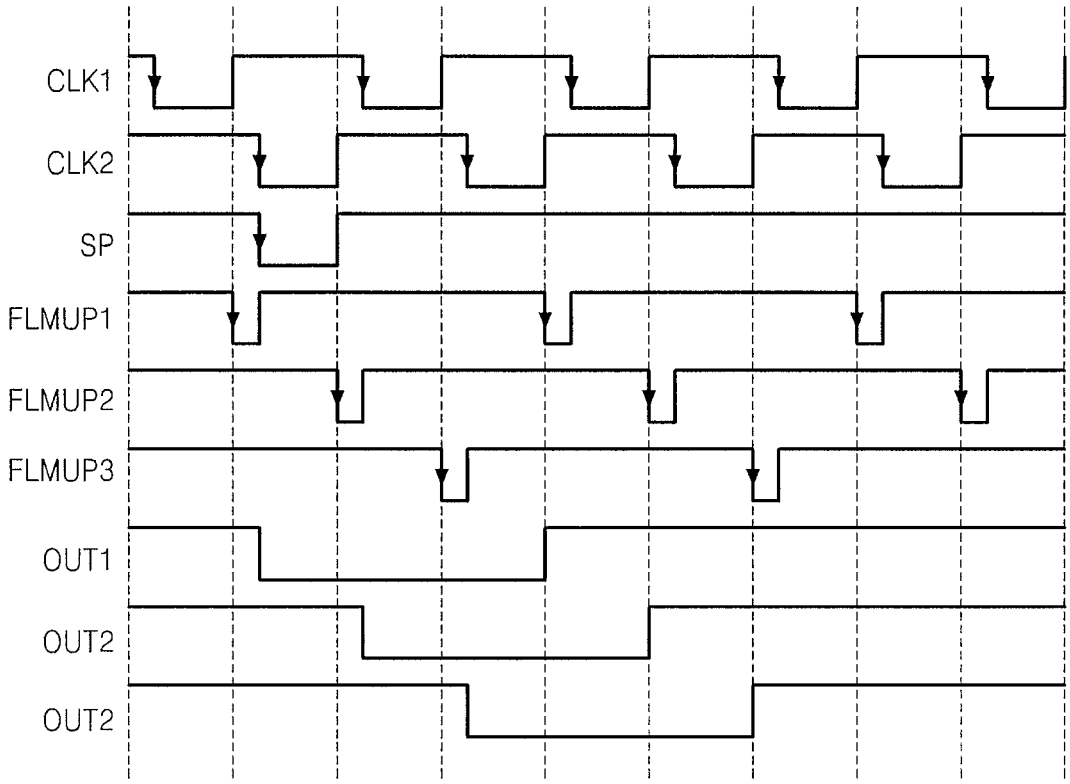
FIG. 8 is a timing diagram illustrating an example of an operation of the scan driver shown in FIG. 7.

FIG. 8 is a timing diagram illustrating an example of an operation of the scan driver 111 shown in FIG. 7.

Referring to FIGS. 7 and 8, a low-level first FLMUP signal is applied to the flmup terminal FLMUP of the first stage S1, a low-level second FLMUP signal is applied to the flmup terminal FLMUP of the second stage S2, and a low-level third FLMUP signal (e.g., a low-level third control signal) is applied to the flmup terminal FLMUP of the third stage S3.

Referring to FIG. 8, in response to an initial input signal from the initial input line SP, the first stage S1 outputs a first output signal to the first scan line Scan[1] via the output terminal OUT of the first stage S1, and outputs a first next signal to the second stage S2 in response to a first clock signal from the first clock line CLK1.

The second stage S2 outputs a second output signal to the second scan line Scan[2] via the output terminal OUT of the second stage S2 in response to the first next signal, and outputs a second next signal to the third stage S3 in response to a second clock signal from the second clock line CLK2.

The third stage S3 outputs a third output signal to the third scan line Scan[3] via the output terminal OUT of the third stage S3 in response to the second next signal.

While the second output signal is being output, the first output signal is not output in response to the first FLMUP signal from the first FLMUP line FLMUP1. Furthermore, while the third output signal is being output, the second output signal is not output in response to the second FLMUP signal from the second FLMUP line FLMUP2. Furthermore, the third output signal is not output in response to the third FLMUP signal from the third FLMUP line FLMUP3. Here, the first output signal and the second output signal overlap each other, and the second output signal and the third output signal also overlap each other.

Figure 9:
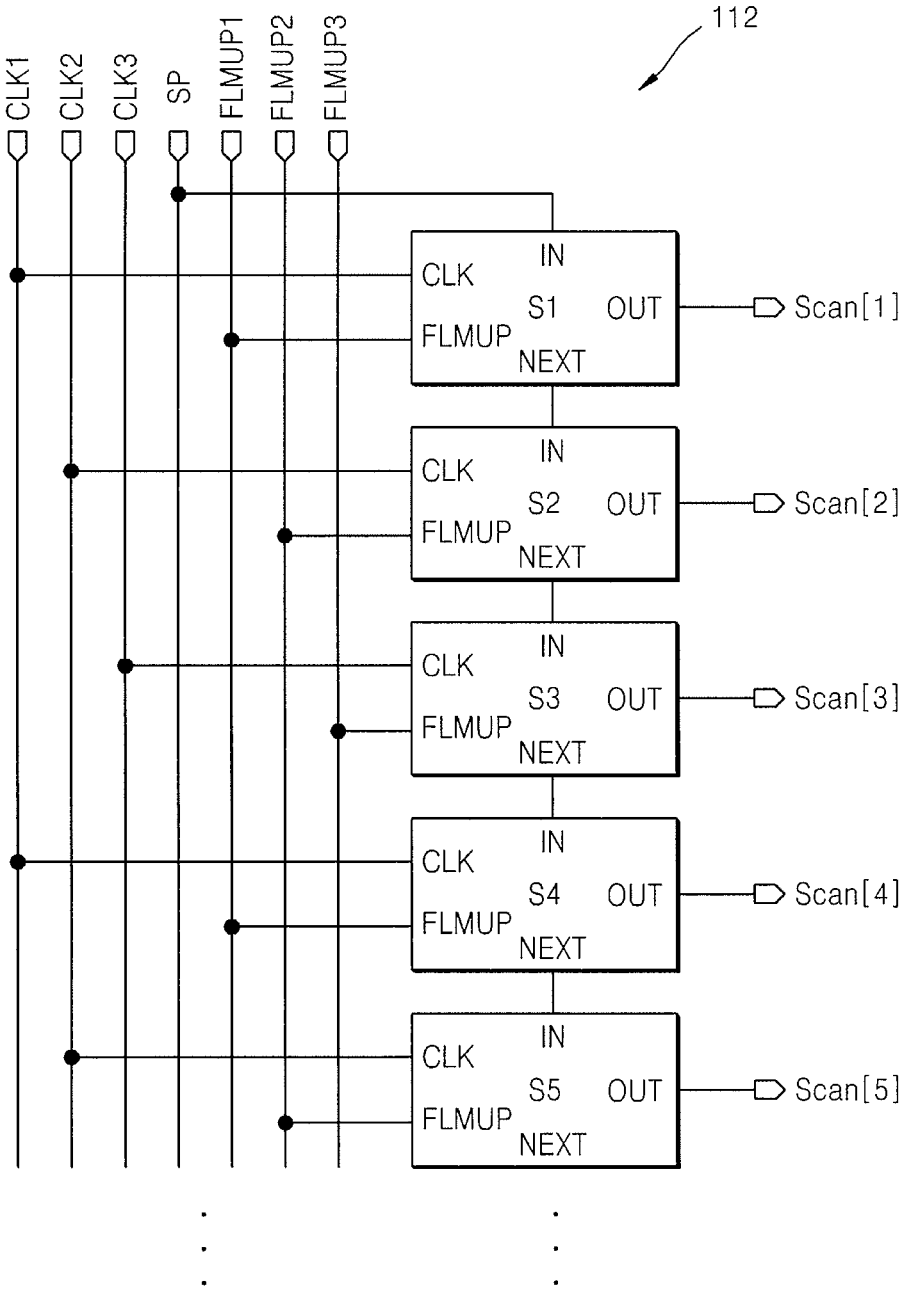
FIG. 9 is a block diagram of a scan driver according to another embodiment of the present invention.

FIG. 9 is a block diagram of a scan driver 112 according to another embodiment of the present invention. The scan driver 112, for example, may replace the scan driver 110 of FIG. 1 in some embodiments. Each of stages shown in FIG. 9 contains the circuit configuration shown in FIG. 3.

According to the embodiment of FIG. 9, the scan driver 112 may further include a third clock line CLK3 and a third FLMUP line FLMUP3, compared to the scan driver 110 of FIG. 2. Referring to FIG. 9, the clock terminal CLK of the third stage S3 is electrically coupled to the third clock line CLK3, and the flmup terminal FLMUP of the third stage S3 is electrically coupled to the third FLMUP line FLMUP3. The clock terminal CLK of the fourth stage S4 is electrically coupled to the first clock line CLK1, and the flmup terminal FLMUP of the fourth stage S4 is electrically coupled to the first FLMUP line FLMUP1. The clock terminal CLK of the fifth stage S5 is electrically coupled to the second clock line CLK2, and the flmup terminal FLMUP of the fifth stage S5 is electrically coupled to the second FLMUP line FLMUP2.

Figure 10:
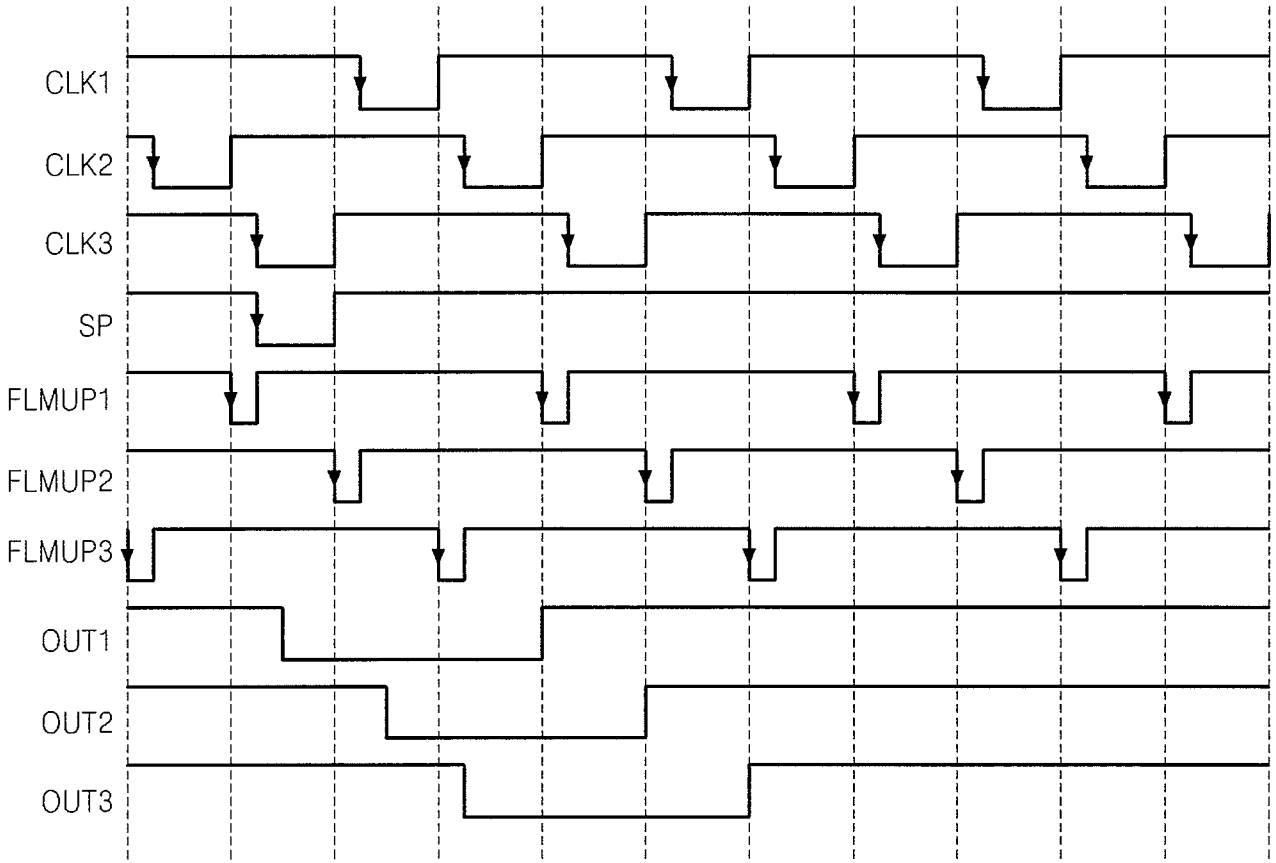
FIG. 10 is a timing diagram illustrating an example of an operation of the scan driver shown in FIG. 9.

FIG. 10 is a timing diagram illustrating an example of an operation of the scan driver 112 shown in FIG. 9.

Referring to FIG. 10, a low-level first FLMUP signal is applied to the flmup terminal FLMUP of the first stage S1, a low-level second FLMUP signal is applied to the flmup terminal FLMUP of the second stage S2, and a low-level third FLMUP signal is applied to the flmup terminal FLMUP of the third stage S3. However, compared to the embodiment shown in FIG. 8, a low-level third clock signal is input to the clock terminal CLK of the third stage S3 in the embodiment of FIG. 10.

As shown in FIGS. 8 and 10, since low-level first through third FLMUP signals are sequentially output by the first through third FLMUP lines FLMUP1 through FLMUP3, overlapping portions of output signals become longer as a number of FLMUP lines increases. In other words, according to the described embodiments of the present invention, the length of overlapping portions of scan signals output by each stage may be controlled by adjusting a number of FLMUP lines. Therefore, a scan driver circuit according to the described embodiments of the present invention features a more simplified configuration and a less number of signal lines, as compared to other scan driver circuits.

Figure 11:
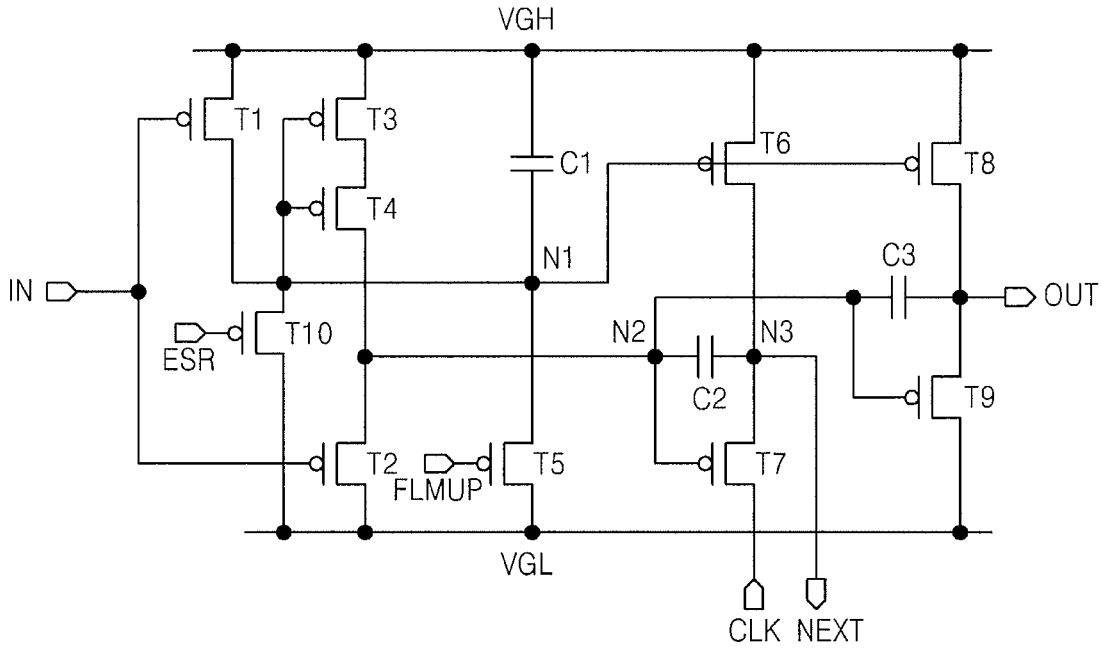
FIG. 11 is a circuit diagram of the scan drivers of FIGS. 2, 7, and 9, according to another embodiment of the present invention.

FIG. 11 is a circuit diagram of the respective scan drivers 110, 111 and 112 of FIGS. 2, 7, and 9, according to another embodiment of the present invention.

According to the embodiment of FIG. 11, a tenth switching device T10 is additionally coupled between the first node N1 and the second power voltage line VGL, compared to the circuit diagram of the scan drivers 110, 111 and 112 of FIG. 3.

A first electrode of the tenth switching device T10 is electrically coupled to the first node N1, a second electrode of the tenth switching device T10 is electrically coupled to the second power voltage line VGL, and a control electrode of the tenth switching device T10 is electrically coupled to a reset terminal ESR. When a low-level reset signal is applied to the reset terminal ESR, the tenth switching device T10 is turned on and applies a second power voltage VGL to the first node N1. As the second power voltage VGL is applied to the first node N1, the eighth switching device T8 is turned on and outputs a first power voltage VGH to the output terminal OUT of each stage. A reset signal is applied before a clock signal is applied. In other words, by a reset signal, a scan signal at a high level is output before a clock signal is applied.

According to embodiments of the present invention, embodiment of overlapped driving of scan signals output by each stage of a scan driver including the stages enables high-speed driving of a large display device.

Furthermore, according to embodiments of the present invention, a scan driver may be configured with a simple circuit.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A scan driver comprising:

a first stage having a clock terminal electrically coupled to a first clock line and a control terminal electrically coupled to a first control line; and a second stage having a clock terminal electrically coupled to a second clock line, and a control terminal electrically coupled to a second control line, wherein the first and second stages are configured to drive a first scan signal output from the first stage and a second scan signal output from the second stage to at least partially overlap each other, wherein each of the first stage and the second stage comprises:

a first switching device having a control electrode electrically coupled to an input terminal, the first switching device being coupled between a first power voltage line and a first node;

a second switching device having a control electrode electrically coupled to the input terminal, the second switching device being coupled between a second power voltage line and a second node;

a third switching device having a control electrode electrically coupled to the first switching device;

a fourth switching device having a control electrode electrically coupled to the first switching device, the fourth switching device being coupled between the third switching device and the second node, wherein the third switching device is coupled between the first power voltage line and the fourth switching device;

a fifth switching device having a control electrode electrically coupled to the first control line, the fifth switching device being coupled between the second power voltage line and the first node;

a sixth switching device having a control electrode electrically coupled to the first node, the sixth switching device being coupled between the first power voltage line and a third node;

a seventh switching device having a control electrode electrically coupled to the second node, the seventh switching device being coupled between the third node and the clock terminal;

an eighth switching device having a control electrode electrically coupled to the first node, the eighth switching device being coupled between the first power voltage line and an output terminal;

a ninth switching device having a control electrode electrically coupled to the second node, the ninth switching device being coupled between the output terminal and the second power voltage line;

a first capacitor coupled between the first power voltage line and the control electrode of the sixth switching device;

a second capacitor coupled between the control electrode of the seventh switching device and the third node; and a third capacitor coupled between the control electrode of the ninth switching device and the output terminal.

2. The scan driver of claim 1, wherein the input terminal of the first stage is electrically coupled to an initial input line, the output terminal of the first stage is electrically coupled to a first scan line, and a next stage start terminal of the first stage is electrically coupled to the input terminal of the second stage.

3. The scan driver of claim 1, wherein the input terminal of the second stage is electrically coupled to a next stage start terminal of the first stage, the output terminal of the second stage is electrically coupled to a second scan line, and a next stage start terminal of the second stage is electrically coupled to the input terminal of a next stage.

4. The scan driver of claim 1, wherein the switching devices comprise PMOS transistors.

5. The scan driver of claim 1, further comprising a tenth switching device having a control electrode electrically coupled to a reset terminal, the tenth switching device being coupled between the first node and the second power voltage line.

6. The scan driver of claim 1, further comprising a third stage, wherein a clock terminal of the third stage is electrically coupled to the first clock line, and a control terminal of the third stage is electrically coupled to a third control line.

7. The scan driver of claim 1, further comprising a third stage, wherein a clock terminal of the third stage is electrically coupled to a third clock line, and a control terminal of the third stage is electrically coupled to a third control line.

8. An organic light emitting display device comprising:

an organic light emitting display panel;

a scan driver configured to sequentially provide scan signals to the organic light emitting display panel via a plurality of scan lines; and a data driver configured to provide data signals to the organic light emitting display panel via a plurality of data lines, wherein the scan driver comprises:

a first stage having a clock terminal electrically coupled to a first clock line and a control terminal electrically coupled to a first control line; and a second stage having a clock terminal electrically coupled to a second clock line and a control terminal electrically coupled to a second control line, wherein the first and second stages are configured to drive a first scan signal output from the first stage and a second scan signal output from the second stage to at least partially overlap each other, wherein each of the first stage and the second stage comprises:

a first switching device having a control electrode electrically coupled to an input terminal, the first switching device being coupled between a first power voltage line and a first node;

a second switching device having a control electrode electrically coupled to the input terminal, the second switching device being coupled between a second power voltage line and a second node;

a third switching device having a control electrode electrically coupled to the first switching device;

a fourth switching device having a control electrode electrically coupled to the first switching device, the fourth switching device being coupled between the third switching device and the second node, wherein the third switching device is coupled between the first power voltage line and the fourth switching device;

a fifth switching device having a control electrode electrically coupled to the first control line, the fifth switching device being coupled between the second power voltage line and the first node;

a sixth switching device having a control electrode electrically coupled to the first node, the sixth switching device being coupled between the first power voltage line and a third node;

a seventh switching device having a control electrode electrically coupled to the second node, the seventh switching device being coupled between the third node and the clock terminal;

an eighth switching device having a control electrode electrically coupled to the first node, the eighth switching device being coupled between the first power voltage line and an output terminal;

a ninth switching device having a control electrode electrically coupled to the second node, the ninth switching device being coupled between the output terminal and the second power voltage line;

a first capacitor coupled between the first power voltage line and the control electrode of the sixth switching device; a second capacitor coupled between the control electrode of the seventh switching device and the third node; and a third capacitor coupled between the control electrode of the ninth switching device and the output terminal.

9. The organic light emitting display device of claim 8, wherein the input terminal of the first stage is electrically coupled to an initial input line, the output terminal of the first stage is electrically coupled to a first scan line of the plurality of scan lines, and a next stage start terminal of the first stage is electrically coupled to the input terminal of the second stage.

10. The organic light emitting display device of claim 8, wherein the input terminal of the second stage is electrically coupled to a next stage start terminal of the first stage, the output terminal of the second stage is electrically coupled to a second scan line of the plurality of scan lines, and a next stage start terminal of the second stage is electrically coupled to an input terminal of a next stage.

11. The organic light emitting display device of claim 8, wherein the switching devices comprise PMOS transistors.

12. The organic light emitting display device of claim 8, wherein each of the first stage and the second stage further comprises a tenth switching device having a control electrode electrically coupled to a reset terminal, the tenth switching device being coupled between the first node and the second power voltage line.

13. The organic light emitting display device of claim 8, further comprising a third stage, wherein a clock terminal of the third stage is electrically coupled to the first clock line, and a control terminal of the third stage is electrically coupled to a third control line.

14. The organic light emitting display device of claim 8, further comprising a third stage, wherein a clock terminal of the third stage is electrically coupled to a third clock line, and a control terminal of the third stage is electrically coupled to a third control line.

* * * * *